US005377795A

United States Patent [19]

Berman

[11] Patent Number: 5,377,795

[45] Date of Patent: Jan. 3, 1995

[54] TWO-WAY TOWABLE LUGGAGE

[75] Inventor: Joseph Berman, Hillsdale, N.J.

[73] Assignee: Vt International Ltd., New York, N.Y.

[21] Appl. No.: 238,920

[22] Filed: May 6, 1994

[51] Int. Cl.[6] ..... A45C 13/00

[52] U.S. Cl. ..... 190/18 A; 280/37; 280/47.26; 280/47.29

[58] Field of Search ..... 190/18 A, 115; 280/47.131, 47.2, 47.27, 47.29, 47.26, DIG. 3, 37

[56] References Cited

U.S. PATENT DOCUMENTS

| | | | |
|---|---|---|---|
| 3,532,355 | 10/1970 | Hawker | 280/47.131 |
| 4,030,768 | 6/1977 | Lugash | 190/18 A X |
| 4,340,132 | 7/1982 | Carna | 190/18 A |
| 4,966,259 | 10/1990 | Bergman | 190/18 A |
| 5,197,578 | 3/1993 | Van Hooreweder | 190/18 A |

*Primary Examiner*—Allan N. Shoap
*Assistant Examiner*—Christopher J. McDonald
*Attorney, Agent, or Firm*—Schweitzer Cornman & Gross

[57] ABSTRACT

A two way towable luggage case comprising a generally parallelepiped body portion having a bottom wall, a top wall, a front wall, a rear wall, and two side walls; said bottom wall having a predetermined longitudinal axis and a predetermined width axis perpendicular to said longitudinal axis; said longitudinal axis defining a first towable direction and said width axis defining a second towable direction; a pair of longitudinally spaced first wheels mounted in fixed axle casters adjacent a first edge of said bottom wall and proximate to said front and rear walls; said first wheels rotating about caster axes parallel to said width axis; a pair of longitudinally spaced second wheels mounted in swivelable casters mounted adjacent a second edge of said bottom wall opposite said first edge; said swivelable casters having swivelable caster axes, whereby said second wheels may rotate on axes parallel to either of said predetermined longitudinal and said predetermined width axes; a telescopic handle associated with said first edge and deployable from a retracted position to a fully extended position; said body being towable by said handle on both said first and second wheels in said longitudinal direction or being towable on said second wheels alone in said width direction with said bottom wall canted from a horizontal plane.

5 Claims, 3 Drawing Sheets

FIG. 1
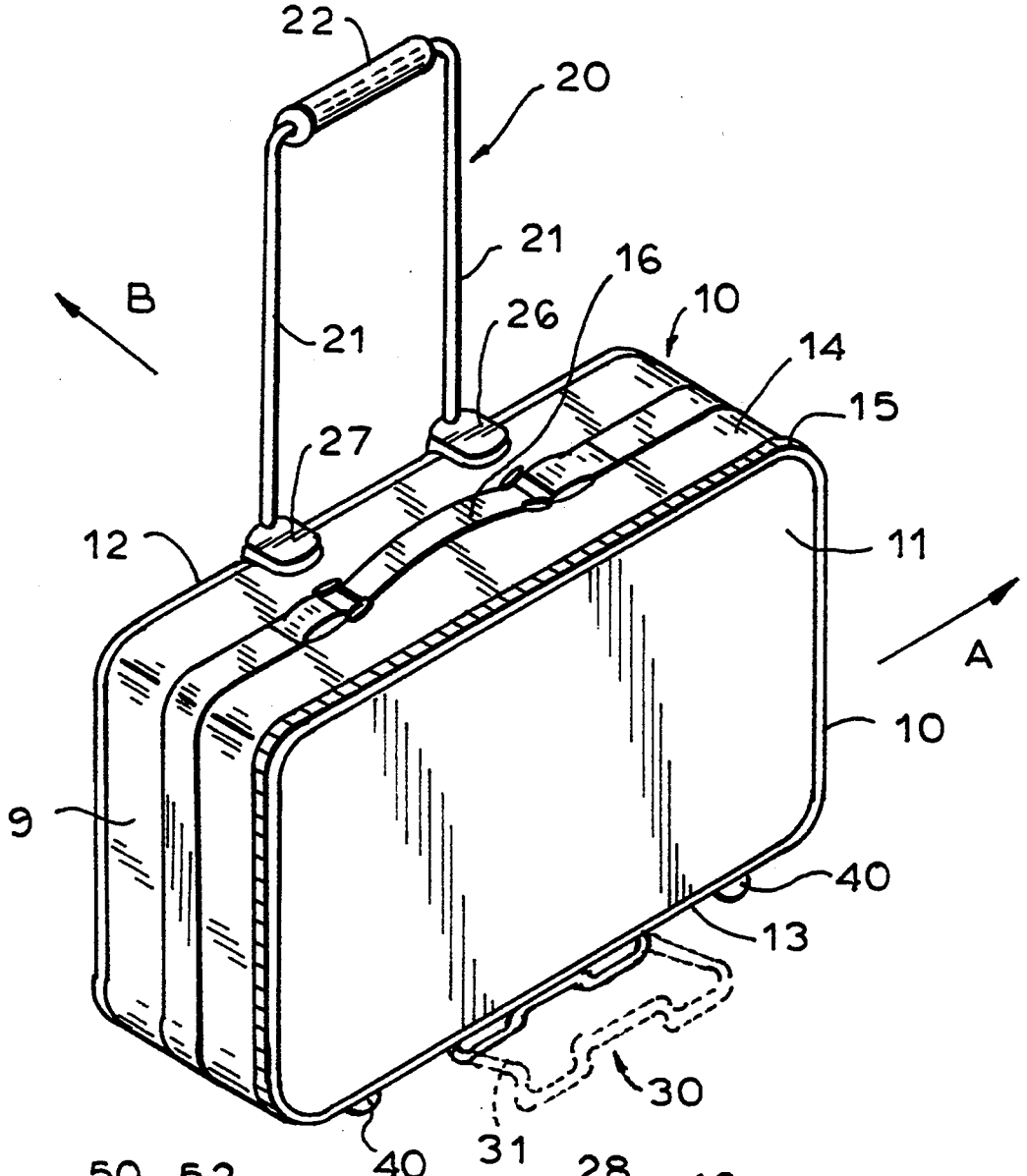
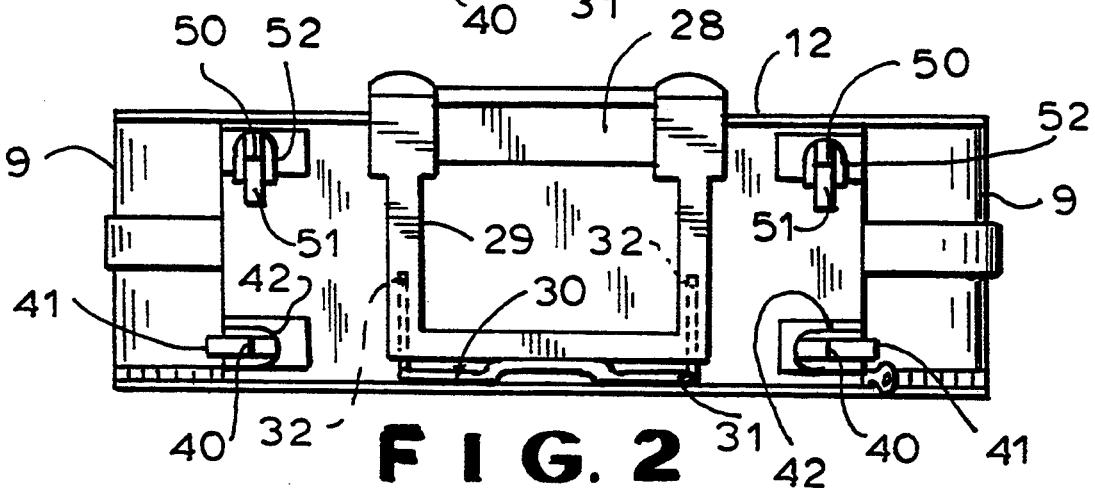
FIG. 2

TWO-WAY TOWABLE LUGGAGE

BACKGROUND AND SUMMARY OF THE INVENTION

The present invention is directed to improvements in wheeled luggage of the type having a deployable handle which is adapted to convert an ordinary piece of four-wheeled luggage into a two-wheeled can for wheeling the luggage while carrying additional luggage on the quasi-cart structure defined by the luggage, its wheels, and its deployed towing handle.

Prior art luggage has included a wide variety of wheeled arrangements permitting towing or rolling of luggage on two or more wheels as well as a variety of luggage constructions in which a deployable handle serves to function along with the wheels and the luggage as a quasi-luggage cart, onto which other luggage may be loaded.

In accordance with the principles of the present invention, a new and improved wheel arrangement is provided in combination with a deployable handle such that the luggage may be wheeled as an ordinary piece of luggage on four wheels in one mode of its operation and may be converted into a luggage cart and wheeled in a direction normal to the first direction when it is operated in its second mode as a luggage can.

The new arrangement includes the use of four casters having cylindrical wheels mounted on axles. Two of the casters have stationary axles and are fixed on one edge of the luggage, while the other two casters have swiveling axles and are attached to the luggage on the opposite edge of the luggage. In this manner, when all four wheels, i.e. the swiveling wheels and the fixed wheels of the casters are aligned in the same direction, the luggage may be wheeled with four-wheel support generally in a first direction, that of the fixed wheels. Alternatively, when it is desired to operate the luggage as a cart, the extendable tow handle is deployed and the luggage is tilted so as to enable the cart to be towed on the two or swivelable casters in a direction normal to that of the fixed axle wheels.

For a more complete understanding of these and other benefits to be derived from the practice of the present invention, reference should be made to the following detailed description of the new and improved two-way towable luggage construction taken in conjunction with the accompanying drawings.

DESCRIPTION OF THE DRAWINGS

FIG. 1 is a perspective view of a valise incorporating the structure of the new and improved two-way towable luggage;

FIG. 2 is a bottom plan view of the luggage of FIG. 1;

DETAILED DESCRIPTION OF THE INVENTION

Figure 3:
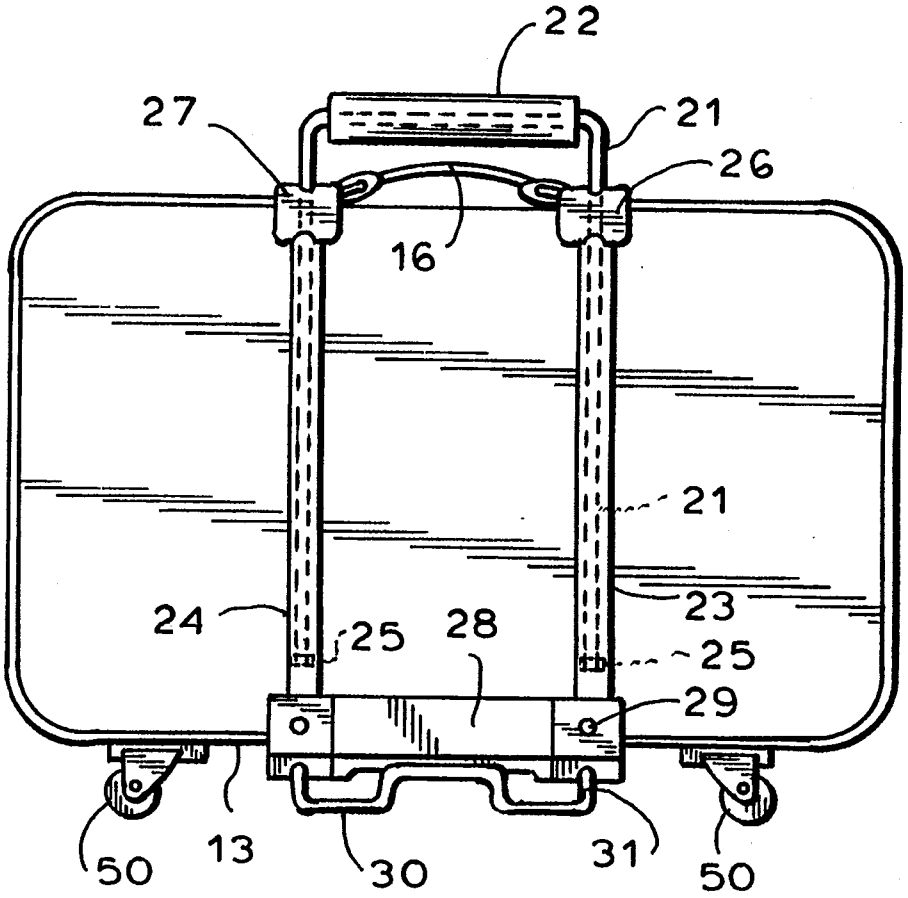
FIG. 3 is a rear elevational view of the luggage of FIG. 1.

Referring now to FIG. 1, the two-way towable luggage of the present invention generally comprises a suitcase 10 which may be either of hard-sided or soft-sided construction, having side walls 9, 10, a front wall 11, a rear wall 12, a bottom wall 13 and a top wall 14 arranged generally to form a closed six-sided parallelepiped structure. Access to the interior of the luggage 10 in the embodiment shown in FIG. 1 may be obtained by opening the front wall 11 from the remainder of the luggage through a zippered closure member 15. As is conventional in luggage of this shape, a hand carrying handle 16 is attached to the top wall 14.

Figure 4:
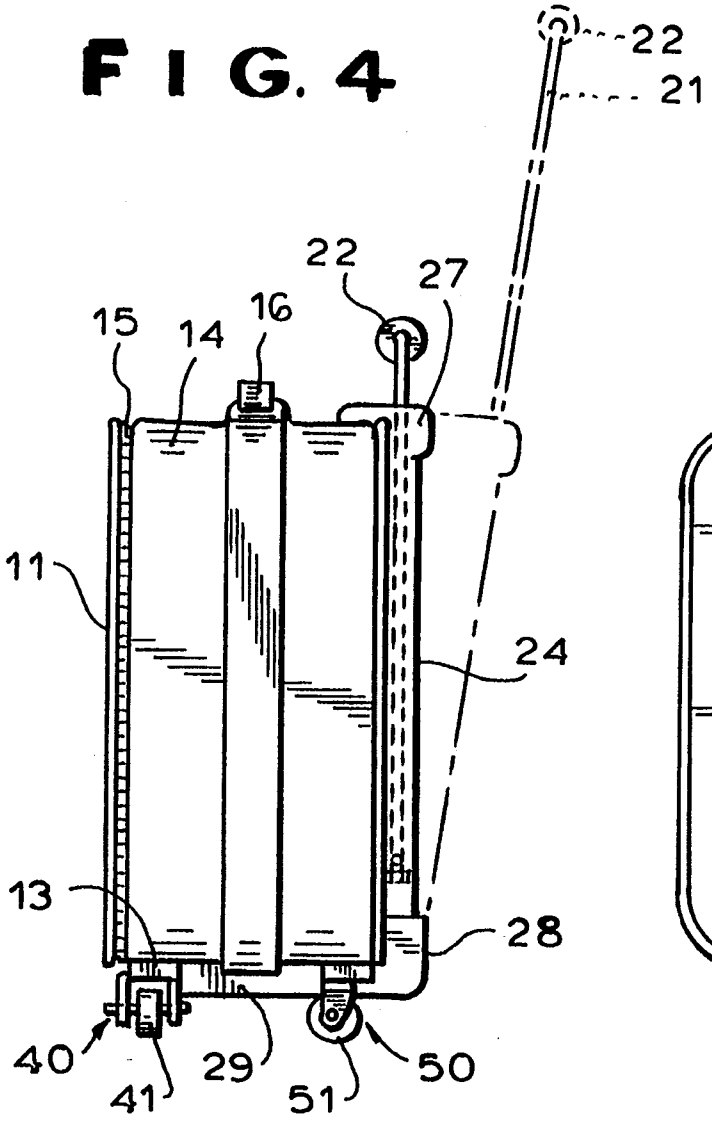
FIG. 4 is side elevational view of the luggage of FIG. 1.

In accordance with the principles of the present invention, a deployable towing handle assembly 20 is associated with the luggage 10. The towing structure includes a U-shaped towing handle 21 having a padded reinforcement or gripping handle 22, the legs 21' of which U-shaped towing handle 21 are slideably frictionally disposed in a pair of vertical guide tubes 23, 24 mounted externally and perpendicular to the long dimension of the luggage as shown in FIGS. 3 and 4. The legs 21' have a pair of friction elements 25 attached to their lowermost ends for engaging the inner walls of the tubes 23, 24 in well known fashion. Thus, the handle 21 may be slid from its retracted position shown in FIG. 3 to its fully extended deployed position shown in FIG. 1 by grasping the handle 22 and pulling upwardly thereon. The handle will be held in its fully mended position or in any intermediate position by the frictional engagement of the friction members 25 with the inner surfaces of the tubes 23, 24.

The tubes 23, 24 are externally connected to the luggage 10 and supported in association therewith by upper tube support members 26, 27 which may be formed of a thermoplastic material and riveted or otherwise attached to the upper portions of the luggage 10 and a lower support bar 28 attached to the bottom portions of the rear wall of the luggage 10 by rivets 29 or otherwise.

As shown in FIG. 2, the lower support 28 includes an additional U-shaped portion 29 which is adapted to support a deployable bracket 30 through legs 31 which are slideably mounted in tubular passages 32 formed in the member 29. The bracket 30 is slidable from a retracted position as shown in FIG. 2, in which the front edge of the bracket 30 is within the periphery of the bottom of the luggage, to an extended position shown in phantom in FIG. 1, in which the bracket 30 projects forwardly and outwardly of the front wall 11 of the luggage. In this position, the bracket 30 is adapted to support an additional piece of luggage thereon when the handle 20 is deployed and the luggage is in the form of a cart adapted to be wheeled in a manner to be described in detail hereinafter.

The unique wheeled support of the luggage 10 is provided by a pair of fixed axle casters 40 attached in-line with one another adjacent the front wall of the luggage and a pair of swiveling casters 50 which are disposed opposite the casters 40 within the periphery of the bottom of the luggage adjacent the rear wall of the luggage 12 as shown best in FIG. 2. In accordance with the principles of the invention, the casters 50 include wheels 51 which are supported within swiveling caster yokes 52 as shown in FIG. 2, while the casters 40 include wheels 41 of the same diameter as the wheels 51 which are supported in fixed caster yokes 42 as shown. The wheels 41 are rotatable about an axis perpendicular to the longitudinal axis of the luggage; the yokes 42 of the casters 40 being fixed and permanently attached to the bottom wall 13, the wheels 41 are rotatable only in a single plane, a plane parallel to the front and rear walls of the luggage. In contrast, the axles of the wheels 51 which are disposed in swiveling casters 50 may be oriented through 360 degrees so that the wheels 51 rotate either parallel to the wheels 41 or perpendicular to the wheels 41, as shown in FIG. 2.

In accordance with the principles of the invention, when the wheels 41, 51 are arranged parallel to one another and the handle 21 is deployed, the luggage may be wheeled in the direction A across a flat surface by towing handle 21 as will be understood. Alternatively, if it is desired to use the luggage as a cart and tow the luggage in direction B, the handle 21 will be deployed and the luggage will be tilted as indicated in FIG. 4. The luggage will be towed in direction B on wheels 51 alone while wheels 41 are elevated above the supporting surface. In this mode of operation and with the bracket 31 extended, additional pieces of luggage may be balanced or otherwise secured to the bracket 32 and/or placed on top of the upper wall 14 of the luggage 10 for balancing against or otherwise being secured against the handle 21 (such as by hooks or straps, not shown) in a manner such that the luggage with its deployed handle 21 and its deployed bracket 32 functions as a luggage cart.

Figure 5:
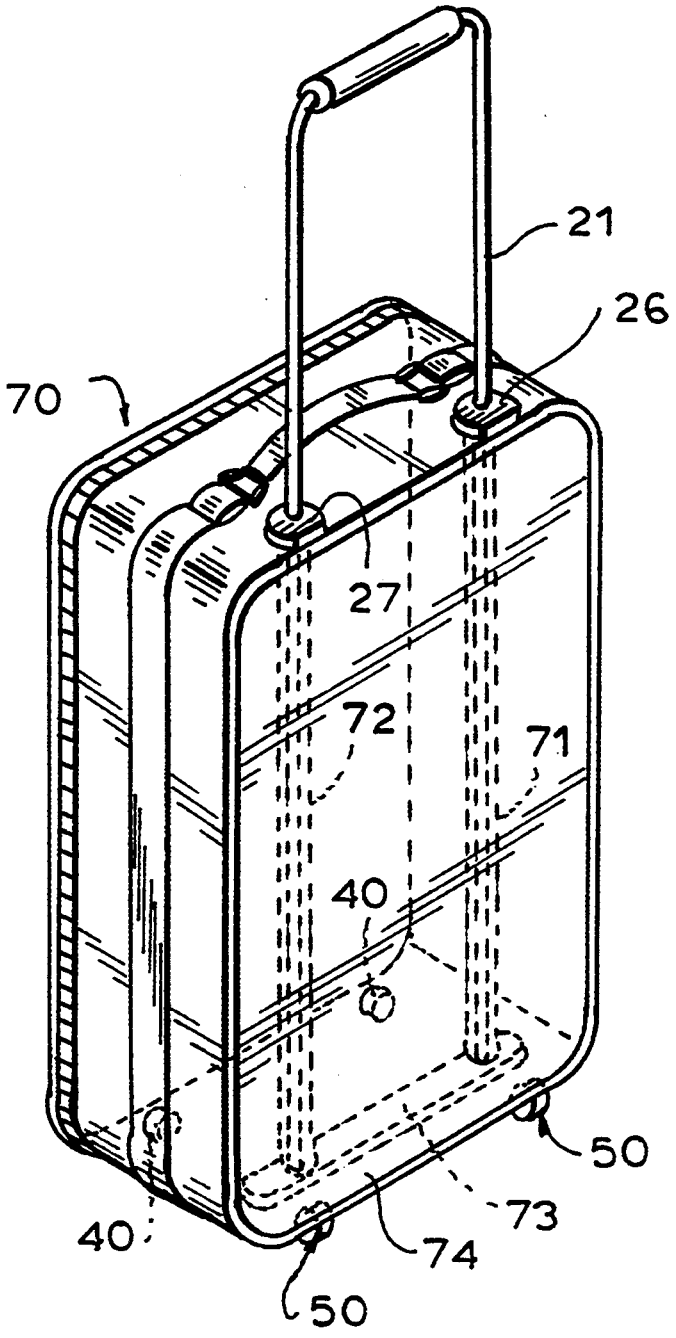
FIG. 5 is a perspective view of an alternative embodiment of the present invention.

The luggage embodiment shown in FIG. 5 generally incorporates the principles of the invention as described in FIGS. 1–4. In the alternative embodiment of FIG. 5, the deployable handle is mounted inside a luggage case 70. In this embodiment the tubular supports for the deployable handle 21 are secured in tubes 71, 72 disposed within the luggage parallel to the long dimension of the case. The tubes 71 and 72 are anchored to a bottom reinforcing plate 73 attached to the luggage wall 74 as will be understood.

In the arrangement of FIG. 5, the swiveling casters 50 are, as in the FIG. 1 embodiment, deployed adjacent the side of the luggage in which the deployable handle is disposed, while the fixed axle casters 40 are disposed opposite thereto.

Thus, in accordance with the principles of the invention, a two-way towable luggage construction may be established by associating a deployable towing handle with one side of a standard piece of luggage and associating two swiveling casters with the bottom of the luggage adjacent the deployable handle while associating two fixed axle casters on the opposite side of the luggage, which fixed axle casters provide for the wheels therein to rotate in a plane parallel to the wall adjacent to which those wheels are disposed.

Although the foregoing description has been given by way of preferred embodiment, it will be understood by those skilled in the art that other forms of the invention falling within the ambit of the following claims is contemplated. Accordingly, reference should be made to the following claims in determining the full scope of the invention.

I claim:

1. A two way towable luggage case comprising (a) a generally parallelepiped body portion having a bottom wall, a top wall, a front wall, a rear wall, and two side walls;

(b) said bottom wall having a predetermined longitudinal axis and a predetermined width axis perpendicular to and shorter than said longitudinal axis;

(c) said longitudinal axis defining a first towable direction and said width axis defining a second towable direction;

(d) a pair of longitudinally spaced first wheels mounted in fixed axle casters adjacent a first edge of said bottom wall and proximate to said front and rear walls; said first wheels rotating about caster axes parallel to said width axis;

(e) a pair of longitudinally spaced second wheels mounted in swivelable casters mounted adjacent a second edge of said bottom wall opposite said first edge;

(f) said swivelable casters having swivelable caster axes, whereby said second wheels may rotate on axes parallel to either of said predetermined longitudinal and said predetermined width axes;

(g) a telescopic handle associated with said first edge and deployable from a retracted position to a fully extended position;

(h) said body being towable by said handle on both said first and second wheels in said longitudinal direction or being towable on said second wheels alone in said width direction with said bottom wall canted from a horizontal plane.

2. The two-way towable luggage case of claim 1, in which (a) said handle is mounted exteriorly of said luggage case.

3. The two-way towable luggage case of claim 1, in which (a) said handle is mounted in tubular elements disposed parallel to the long dimension of said luggage case.

4. The two-way towable luggage case of claim 3, in which (a) said swivelable casters are mounted adjacent the lower ends of said tubular elements.

5. The two-way towable luggage case of claim 4, in which (a) a deployable bracket is associated with a lower portion of said case opposite the lower ends of said tubular elements.

* * * * *